US008713755B1

(12) United States Patent
Cochran

(10) Patent No.: US 8,713,755 B1
(45) Date of Patent: May 6, 2014

(54) INSERT ASSEMBLY FOR AN APPLICATOR

(71) Applicant: Spatz Laboratories, Oxnard, CA (US)

(72) Inventor: Monroe Adler Cochran, Oxnard, CA (US)

(73) Assignee: Spatz Laboratories, Oxnard, CA (US)

( * ) Notice: Subject to any disclaimer, the term of this patent is extended or adjusted under 35 U.S.C. 154(b) by 51 days.

(21) Appl. No.: 13/676,533

(22) Filed: Nov. 14, 2012

(51) Int. Cl.
*B43K 29/02* (2006.01)
*B43L 19/00* (2006.01)

(52) U.S. Cl.
USPC ..... 15/431; 15/425; 15/427; 401/19; 401/37; 401/52

(58) Field of Classification Search
USPC ..... 15/424–434, 3.53, 168, 177, 178, 190, 15/191.1, 194, 209.1, 244.1; 132/317, 132/318, 320; 401/17, 19, 20, 37, 52
See application file for complete search history.

(56) References Cited

U.S. PATENT DOCUMENTS

| | | | | | |
|---|---|---|---|---|---|
| 376,196 | A | * | 1/1888 | Hoffman | 15/434 |
| 863,306 | A | * | 8/1907 | Mcintyre | 15/432 |
| 1,136,094 | A | * | 4/1915 | Bowen | 15/432 |
| 1,373,062 | A | * | 3/1921 | Faber | 15/434 |
| 2,146,564 | A | * | 2/1939 | Collins | 15/430 |
| 2,147,310 | A | * | 2/1939 | Morrison | 427/189 |

FOREIGN PATENT DOCUMENTS

JP 8-108693 * 4/1996

* cited by examiner

*Primary Examiner* — Mark Spisich

(57) ABSTRACT

An insert assembly for an applicator is built from two semi-cylindrical retention jaws connected by a living hinge. Each of the semi-cylindrical retention jaws has a plurality of stake pins, while the first semi-cylindrical retention jaw has a locator receptacle and the second semi-cylindrical retention jaw has a locator insert. An insert is placed between the two retention jaws, which then close to secure the insert between the retention jaws. The locator receptacle receives the locator insert from the second semi-cylindrical retention jaw, helping to align the two retention jaws. The plurality of stake pins impale the insert, holding it in place. In addition to being secured by the stake pins, the insert is supported by an interior ridge. The insert assembly can then be slid into a barrel sleeve, held in place by a press fit or by a removable mounting system, such as a lug mount.

19 Claims, 12 Drawing Sheets

INSERT ASSEMBLY FOR AN APPLICATOR

FIELD OF THE INVENTION

The present invention relates generally to an assembly for securing an insert to an barrel-sleeved applicator. More specifically, the present invention secures an insert with stake pins positioned along two jaws, prior to being connected to an applicator.

BACKGROUND OF THE INVENTION

There are many products that incorporate an insert for use in combination with the products primary function. A common example of this is a pencil, mechanical pencil, or even pen, all primarily used as writing utensils. However, since mistakes and errors occur when writing, there is a need for correcting those errors. This is achieved by the ubiquitous eraser, a rubber insert used to remove writing from papers. Erasers are often incorporated into writing utensils for increased functionality.

Another common use of inserts is the smudger or applicator found in eyeliner products. The smudger or applicator allows provides convenience by allowing a user to adjust applications of makeup without having to resort to a separate tool. One end can be used to apply the makeup product, while the opposite end can be used to blend or draw the applied makeup.

Commonly, connecting an insert to an applicator is achieved by methods such as staking or gluing. However, glue is messy and there is a possibility of contamination. Staking is problematic when trying to secure large diameter, low durameter foamed rubbers, elastomers, or rubber compounds.

Therefore, it is an object of the present invention to provide an apparatus with the ability to secure an insert to an applicator without the need for glue or staking. It is a further object of the present invention to provide a removable apparatus with a user replaceable insert.

DETAIL DESCRIPTIONS OF THE INVENTION

Terminology and Lexicography

Figure 1:
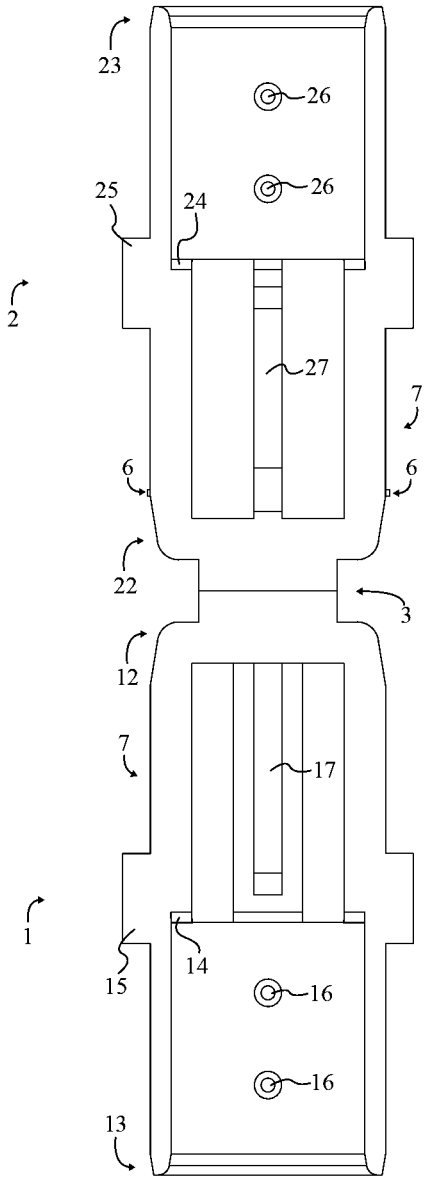
FIG. 1 is a front view of the present invention in an open configuration.

Insert: A separate smudging component that refers to an eraser or applicator.

All illustrations of the drawings are for the purpose of describing selected versions of the present invention and are not intended to limit the scope of the present invention.

The present invention is an assembly designed to install and secure an insert, such as an eraser, into a retainer sleeve such as the barrel of a mechanical pencil. Furthermore, the present invention, as shown in FIG. 1-FIG. 12, comprises a first semi-cylindrical retention jaw 1, a second semi-cylindrical retention jaw 2, a living hinge 3, an interior cavity 4, a cylindrical over cap 5, and a plurality of attachment points 6. By engaging these components, an eraser or other insert can be held in the internal cavity, depicted in FIG. 4, FIG. 5, FIG. 8, and FIG. 12. The present invention can then be inserted into a mechanical pencil or other retainer sleeve, providing a means to secure an insert without the use of glue or mechanical staking.

Figure 2:
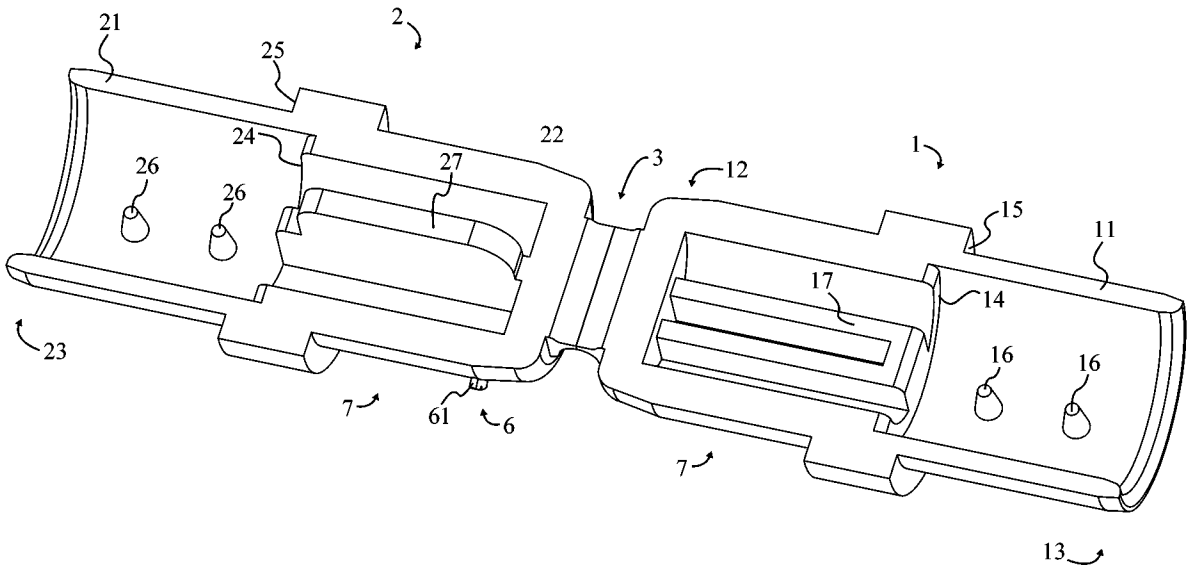
FIG. 2 is a perspective view of the present invention in an open configuration.
Figure 3:
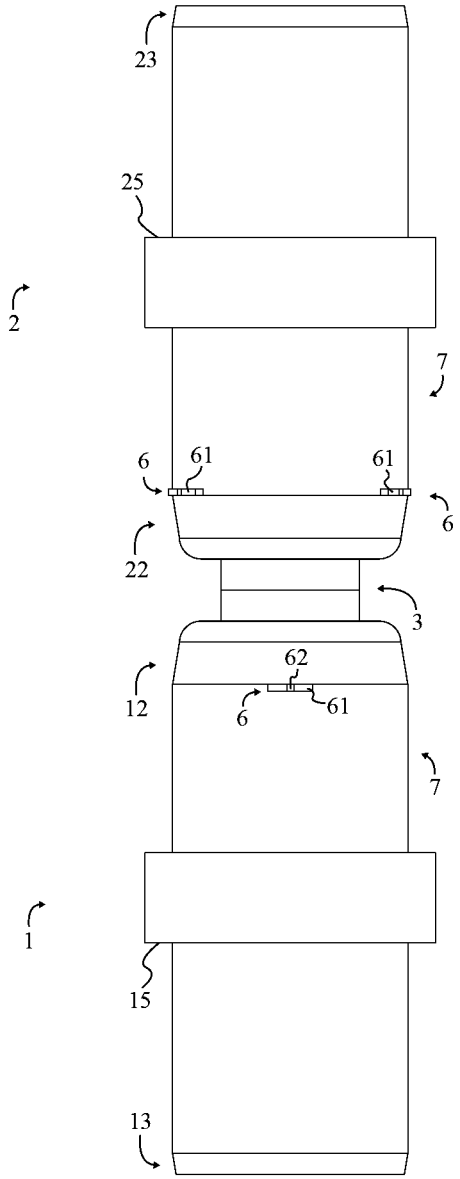
FIG. 3 is a rear view of the present invention in an open configuration.

The first semi-cylindrical retention jaw 1 is connected to the second semi-cylindrical retention jaw 2 by the living hinge 3, like shown in FIG. 1-FIG. 3. Between the closed first semi-cylindrical retention jaw 1 and the second semi-cylindrical retention jaw 2 is the interior cavity 4. The interior cavity 4 holds an insert, illustrated in FIG. 4 and FIG. 5, which protrudes out of the interior cavity 4 allowing the insert to be used.

Figure 6:
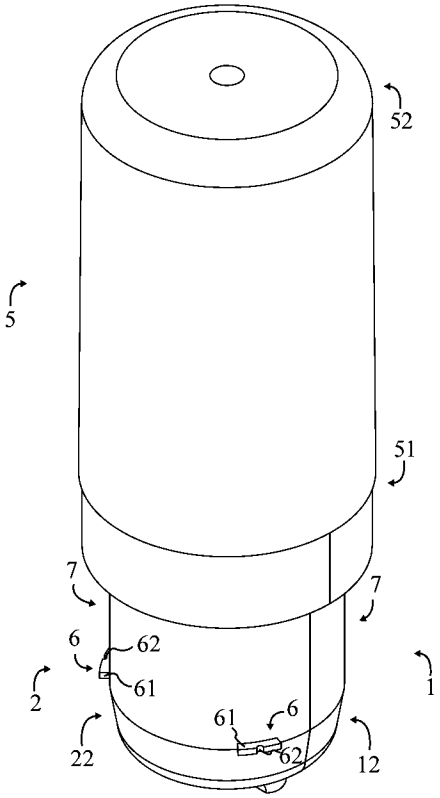
FIG. 6 is a perspective view of the present invention including a cylindrical over cap.
Figure 7:
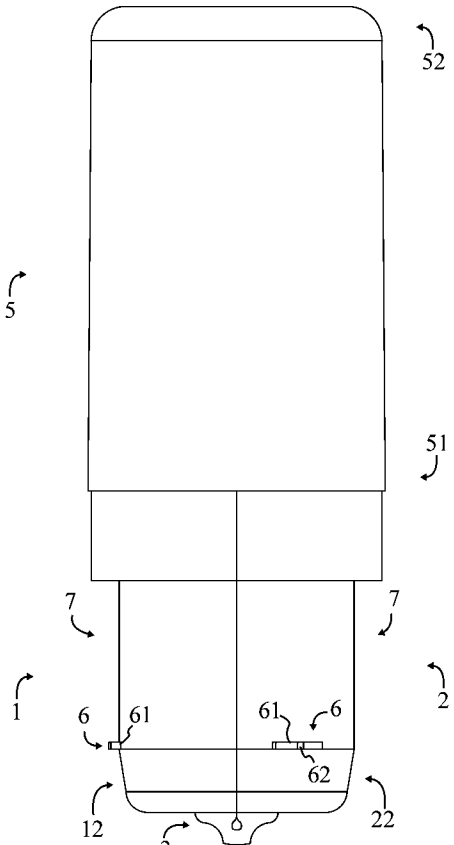
FIG. 7 is a side view of the present invention including the cylindrical over cap.
Figure 8:
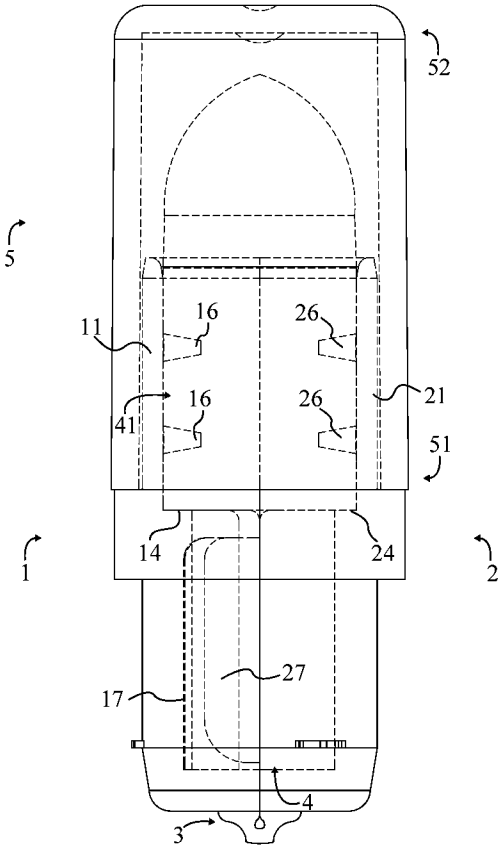
FIG. 8 is an internal side view of the present invention including the cylindrical over cap.
Figure 9:
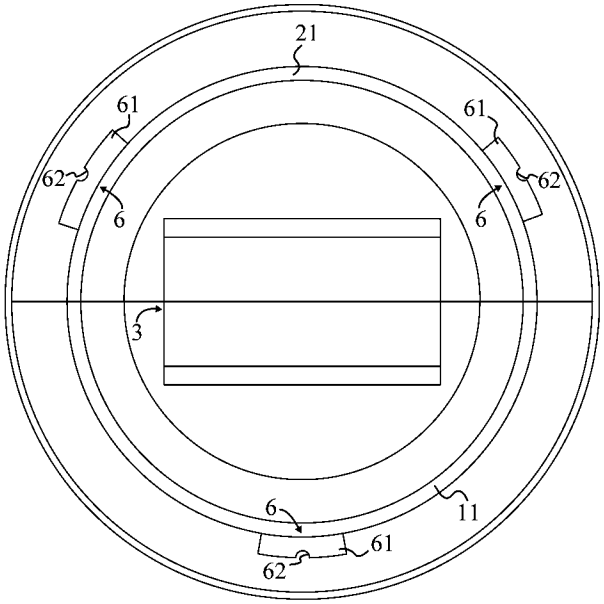
FIG. 9 is a bottom view of the present invention including the cylindrical over cap.
Figure 10:
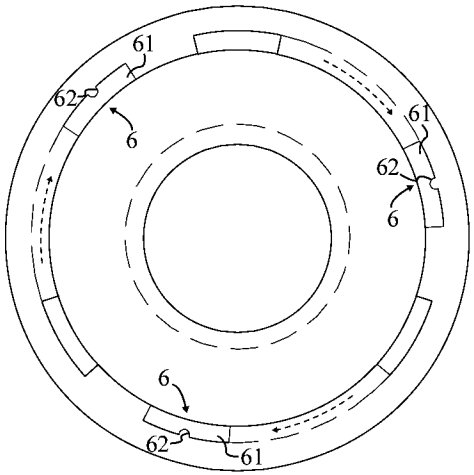
FIG. 10 is a top view showing the rotation of the present invention.
Figure 11:
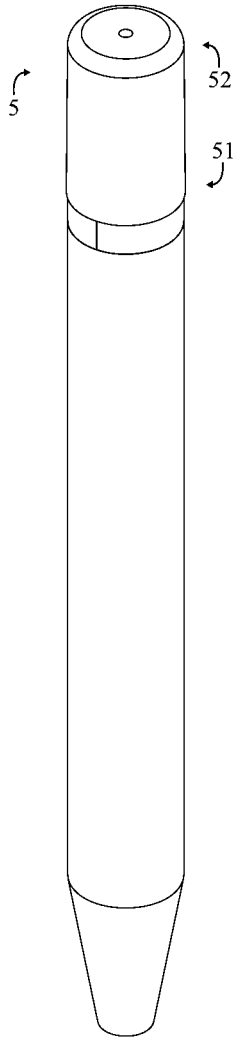
FIG. 11 is a perspective view of the present invention inserted into an applicator.
Figure 12:
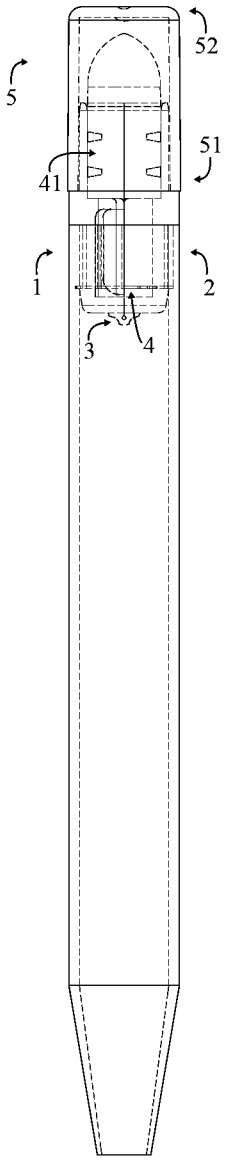
FIG. 12 is an internal side view of the present invention inserted into an applicator.

Shown in FIG. 6-FIG. 8, the cylindrical over cap 5 slides over the first semi-cylindrical retention jaw 1 and second semi-cylindrical retention jaw 2, covering and protecting the insert when not in use. The plurality of attachment points 6 seen in FIG. 9 and FIG. 10 are positioned around the first semi-cylindrical retention jaw 1 and the second semi-cylindrical retention jaw 2, at the same end as the living hinge 3. These attachment points 6 allow the present invention to be inserted into and removed from a barrel sleeve, providing users and manufacturers with an easy way to install and replace inserts in applicators, as depicted in FIG. 11 and FIG. 12.

As illustrated in FIG. 1-FIG. 3, the first semi-cylindrical retention jaw 1 comprises a first concave wall 11, a first connection end 12, a first open end 13, a first interior ridge 14, a first exterior ridge 15, a first plurality of stake pins 16, and a locator receptacle 17. The first connection end 12 and first open end 13 are located opposite each other along the first concave wall 11; the first open end 13 allows the insert to protrude from the present invention and be used, while the first connection end 12 serves as connection point between the first semi-cylindrical retention jaw 1 and the living hinge 3. The first interior ridge 14 is positioned around the inside face of the first concave wall 11, between the first connection end 12 and the first open end 13. The first interior ridge 14, in combination with components from the second semi-cylindrical retention jaw 2, serves as a support for the insert. The first exterior ridge 15 forms an arc along the outside of the first concave wall 11, essentially mirroring the first interior ridge 14 across the first concave wall 11. Similar to the first interior ridge 14, the first exterior ridge 15 acts as a support, although for the cylindrical over cap 5 rather than the insert. Located along the interior face of the first concave wall 11 are the first plurality of stake pins 16 and the locator receptacle 17. The first plurality of stake pins 16 and the locator receptacle 17 are aligned with each other, bisecting the first concave wall 11 between the first connection end 12 and the first open end 13.

More specifically, the first plurality of stake pins 16 and the locator receptacle 17 are linearly positioned such that they bisect the arc that forms the first concave wall 11. The first plurality of stake pins 16 and the locator receptacle 17 are separated from each other by the first interior ridge 14; the first plurality of stake pins 16 is positioned between the first open end 13 and the first interior ridge 14 while the locator receptacle 17 is positioned between the first connection end 12 and the first interior ridge 14. The first plurality of stake pins 16 and the locator receptacle 17 are perpendicular to the surface of the first concave wall 11, allowing them to engage with the insert and certain components from the second semi-cylindrical retention jaw 2. To enable these interactions, the locator receptacle 17 has a cavity that receives a matching component from the first semi-cylindrical retention jaw 1.

The second semi-cylindrical retention jaw 2 is very similar to the first semi-cylindrical retention jaw 1, and as a result many of the components are the same. The second semi-cylindrical retention jaw 2, as shown in FIG. 1-FIG. 3, comprises a second concave wall 21, a second connection end 22, a second open end 23, a second interior ridge 24, a second exterior ridge 25, a second plurality of stake pins 26, and a locator insert 27. The majority of these components have the same positioning and relations as the corresponding components of the first semi-cylindrical retention jaw 1. Opposite to each other along the second concave wall 21 are the second connection end 22 and the second open end 23. The second interior ridge 24 and second exterior ridge 25 are positioned opposite each other around the second concave face, with the second interior ridge 24 being located along the interior face of the second concave wall 21 and the second exterior ridge 25 being located along the exterior face of the second concave wall 21. The second plurality of stake pins 26 and the locator insert 27 parallel the first plurality of stake pins 16 and the locator receptacle 17, being aligned along a path that bisects the arc of the second concave wall 21. As with the first semi-cylindrical locator receptacle 17, the second plurality of stake pins 26 and the locator insert 27 are perpendicular to the surface of the first concave wall 11. The locator insert 27 protrudes from the second concave wall 21 and is shaped to be inserted into and engage with the locator receptacle 17 of the first semi-cylindrical retention jaw 1.

The living hinge 3 connects the first semi-cylindrical retention jaw 1 and the second semi-cylindrical retention jaw 2, as depicted in FIG. 1-FIG. 5. More specifically, the first connection end 12 and the second connection end 22 are joined to each other by the living hinge 3. This connection allows the first semi-cylindrical retention jaw 1 and the second semi-cylindrical retention jaw 2 to be switched between an open position and a closed position. In the preferred embodiment, the first semi-cylindrical retention jaw 1, the second semi-cylindrical retention jaw 2, and the living hinge 3 are produced from a single mold. In other embodiments, it is possible to mold the first semi-cylindrical retention jaw 1 and the second semi-cylindrical jaw separately, using an independent hinge to connect the two components. However, this sacrifices some of the simplicity of the preferred single mold process with a living hinge 3.

In a closed configuration, such as when installed into a mechanical pencil, the first semi-cylindrical retention jaw 1 and second semi-cylindrical retention jaw 2 are positioned adjacent to each other, examples of which are shown in FIG. 4-FIG. 8. As a result, the first concave wall 11 and second concave wall 21 line up to form a continuous circular wall, with the first interior ridge 14, second interior ridge 24, first exterior ridge 15, and second exterior ridge 25 meeting to form a circular interior ridge and a circular exterior ridge. The locator insert 27 engages with the locator receptacle 17, helping to align and secure the second semi-cylindrical retention jaw 2 to the first semi-cylindrical retention jaw 1. In the closed configuration, the first plurality of stake pins 16 are aligned with the second plurality of stake pins 26, helping to secure the insert between the first semi-cylindrical retention jaw 1 and second semi-cylindrical retention jaw 2.

Figure 5:
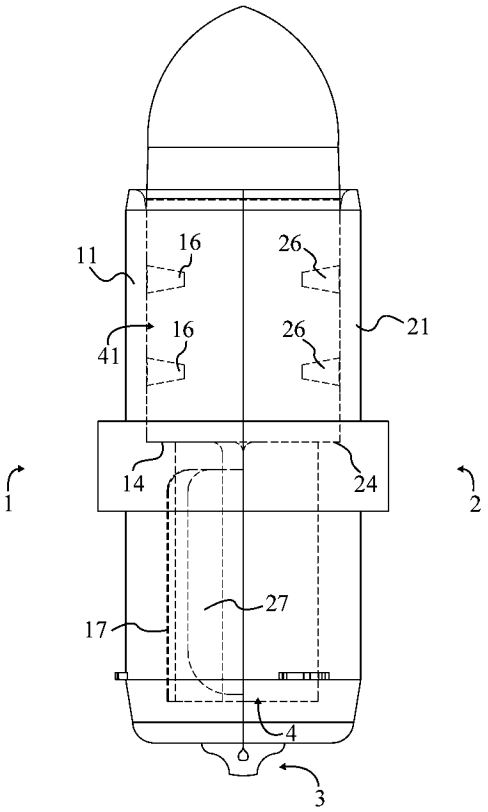
FIG. 5 is an internal view the present invention in a closed configuration with the eraser.

Visible in FIG. 5, FIG. 8, and FIG. 12, the interior cavity 4 is the area inside the present invention, positioned between the first semi-cylindrical retention jaw 1 and the second semi-cylindrical retention jaw 2. The end boundaries of the interior cavity 4 are formed by the first open end 13, the second open end 23, the first connection end 12, and the second connection end 22. The interior cavity 4 contains several components from the first semi-cylindrical retention jaw 1 and the second semi-cylindrical retention jaw 2, specifically the first interior ridge 14, the second interior ridge 24, the first plurality of stake pins 16, the second plurality of stake pins 26, the locator receptacle 17, and the locator insert 27. In addition to housing the above components, the interior cavity 4 comprises an insert section 41. The insert section 41, intended to receive and hold an insert, is defined as the space of the interior cavity 4 between the first concave wall 11 and the second concave wall 21, with a length running from the first open end 13 and second open end 23 to the first interior ridge 14 and second interior ridge 24.

The cylindrical over cap 5 comprises an open end 51 and a closed end 52. The open end 51 allows the cylindrical over cap 5 to slide over the first semi-cylindrical retention jaw 1 and second semi-cylindrical retention jaw 2. The closed end 52 serves to cover the upper end of the insert, protecting the insert from unnecessary wear and tear. The cylindrical over cap 5 covers the insert when the present invention is not in use, with the open end 51 of the insert resting against the first exterior ridge 15 and the second exterior ridge 25.

Just as the insert section 41 allows the present invention to receive and secure an insert, the present invention comprises a sleeve insertion section 7 that engages with the barrel of a mechanical pencil. Shown in FIG. 1-FIG. 4, FIG. 6, and FIG. 7, the sleeve insertion section 7 is formed around the outside the first semi-cylindrical retention jaw 1 and second semi-cylindrical retention jaw 2. The sleeve insertion section 7 extends from both the first connection end 12 and second connection end 22 to the first exterior ridge 15 and the second exterior ridge 25. Effectively, the sleeve insertion section 7 is positioned opposite the insert section 41, although the sleeve insertion section 7 is formed along the exterior faces while the insert section 41 is formed between the interior faces of the present invention.

As seen in FIG. 3, FIG. 9, and FIG. 10, the plurality of attachment points 6 is positioned around the outside of the circular wall formed by the first concave wall 11 and second concave wall 21. Essentially, the plurality of attachment points 6 is connected concentric to the outside faces of the first concave wall 11 and the second concave wall 21. Each of the plurality of attachment points 6 comprises a semi-circular ridge 61. The semi-circular ridge 61, also known as a lug, comprises a notch 62. The semi-circular ridge 61s are positioned concentrically with both the first semi-cylindrical retention jaw 1 and the second semi-circular retention jaw.

Figure 4:
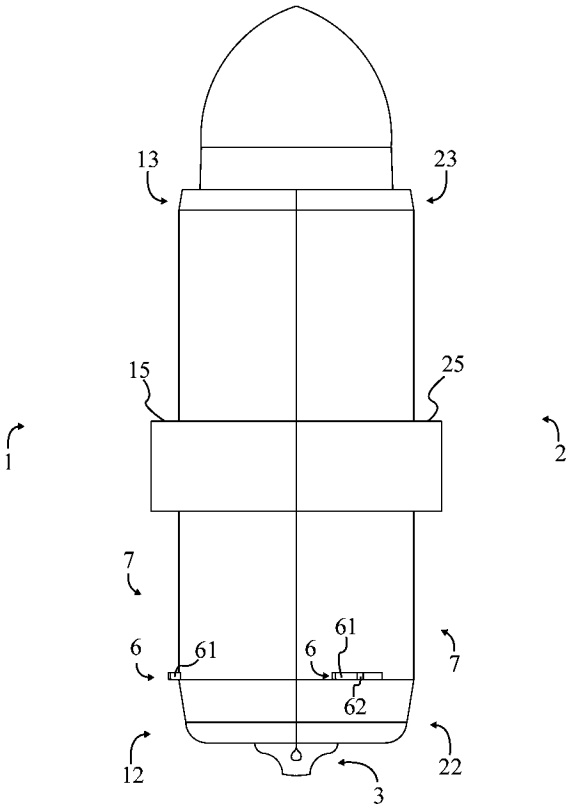
FIG. 4 is side view of the present invention in a closed configuration with an eraser.

The components of the present invention are designed and arranged to receive and secure an insert prior to being installed into a barrel sleeve. This is achieved by starting with the present invention in the open configuration, with the first semi-cylindrical retention jaw 1 and second semi-cylindrical retention jaw 2 separated from each other. The first step is to take the insert and position it flush with the interior face of the first concave wall 11, with a bottom face of the insert being flush with the first interior ridge 14. This will result in the insert being impaled by the first plurality of stake pins 16. At this point, the present invention can be switched to a closed configuration by bending the living hinge 3 and bring the first semi-cylindrical retention jaw 1 and second semi-cylindrical retention jaw 2 together, clamping the insert between them. In doing so, the locator insert 27 will engage with the locator receptacle 17, while the second plurality of stake pins 26 will impale the insert opposite the first plurality of stake pins 16. As a result, the insert will be secured in the insert section 41 of the interior cavity 4; the insert is held between the first concave wall 11 and the second concave wall 21, supported by the first interior ridge 14 and second interior ridge 24, and secured by the first plurality of stake pins 16 and second plurality of stake pins 26. This state is depicted in FIG. 4 and FIG. 5. To be usable, the insert must be longer than the insert section 41; as a result, part of the insert protrudes past the first open end 13 and second open end 23, allowing the insert to be utilized.

Once the first semi-cylindrical retention jaw 1 and second semi-cylindrical retention jaw 2 have been brought together to secure the insert, the cylindrical over cap 5 may be placed to cover the insert. The cylindrical over cap 5, which has a radius slightly larger than that of the circular wall, simply slides over the outside of the circular wall, with the open end 51 oriented towards the circular wall. The cylindrical over cap 5 is supported by the first exterior ridge 15 and second exterior ridge 25, which help to hold the cylindrical over cap 5 in place when the insert is not in use. FIG. 6-FIG. 8 illustrate the final positioning of the cylindrical over cap 5.

After the insert is secured within the present invention and the cylindrical over cap 5 positioned to cover the insert, the present invention can be installed into a sleeve, such as the barrel of a mechanical pencil. Shown in FIG. 11 and FIG. 12, this is accomplished by sliding the present invention into a sleeve, with the sleeve insertion section 7 oriented to the sleeve. The present invention is pushed into the sleeve until the first exterior ridge 15 and second exterior ridge 25 hit the edge of the sleeve, preventing the sleeve insertion end from sliding in any further. To be able to interact with the sleeve as such, the radius of the first concave wall 11 and second concave wall 21 must be slightly smaller than the radius of the sleeve, providing a secure press fit between the present invention and the sleeve. At this point the present invention can be rotated, allowing the semi-circular ridges 61, or lugs, to engage with received parts on the interior of the sleeve. This lug mounting system allows a simple twist of 45 degrees to completely secure the present invention within the sleeve, as indicated in FIG. 9 and FIG. 10. In addition, by releasing the mounting system, the present invention can be twisted and removed from the sleeve. This functionality allows for user replaceable inserts, if so desired.

Similarly, the cylindrical over cap 5 is replaceable. Since the cylindrical over cap 5 is not permanently connected, it is possible for replacement a replacement cylindrical over cap 5 to be used to cover the insert. In other embodiments the cylindrical over cap 5 may be deemed unnecessary, with such embodiments foregoing the use of the cylindrical over cap 5.

Alternatively, the present invention can be built without the plurality of attachment points 6, if a manufacturer feels that it is unnecessary or not cost-effective to allow for user replaceable inserts. In such a variation, the present invention is simply secured in the sleeve with a press fit. Other possible variations include using a different insert, such as one made from foam rather than rubber.

Although the invention has been explained in relation to its preferred embodiment, it is to be understood that many other possible modifications and variations can be made without departing from the spirit and scope of the invention as hereinafter claimed.

What is claimed is:

1. An insert assembly for an applicator,
- a first semi-cylindrical retention jaw;
- a second semi-cylindrical retention jaw;
- a living hinge;
- an interior cavity;
- a cylindrical over cap;
- a plurality of attachment points;
- the first semi-cylindrical retention jaw comprises a first concave wall, a first connection end, a first open end, a first interior ridge, a first exterior ridge, a first plurality of stake pins, and a locator receptacle;
- the second semi-cylindrical retention jaw comprises a second concave wall, a second connection end, a second open end, a second interior ridge, a second exterior ridge, a second plurality of stake pins, and a locator insert;
- the first connection end being coupled to the second connection end by the living hinge;
- the interior cavity being positioned opposite the living hinge between the first semi-cylindrical retention jaw and the second semi-cylindrical retention jaw; and
- the plurality of attachment points being connected outside and around the first concave wall and the second concave wall.

2. The insert assembly for an applicator as claimed in claim 1 comprises,
- the first connection end and the first open end being positioned opposite each other along the first concave wall;
- the locator receptacle being positioned in the interior cavity and connected to the first concave wall;
- the locator receptacle being normal to and bisecting the first concave wall;
- the locator receptacle being positioned adjacent to the first connection end;
- the first plurality of stake pins being positioned in the interior cavity and connected normal to the first concave wall;
- the first plurality of stake pins being collinear with the locator receptacle;
- the first interior ridge being positioned inside the interior cavity and connected around the first concave wall;
- the first interior ridge being positioned adjacent to the locator receptacle opposite the living hinge;
- the first exterior ridge being positioned outside and connected around the first concave wall opposite the first interior ridge; and
- the first exterior ridge being positioned between the first connection end and the first open end.

3. The insert assembly for an applicator as claimed in claim 2 comprises;
- the first plurality of stake pins being aligned opposite the second plurality of stake pins.

4. The insert assembly for an applicator as claimed in claim 1 comprises,
- the second connection end and the second open end being positioned opposite each other along the second concave wall;
- the locator insert being positioned in the interior cavity and connected to the second concave wall;
- the locator insert being normal to and bisecting the second concave wall;

the locator insert being positioned adjacent to the second connection end;

the locator insert being engaged with the locator receptacle;

the second plurality of stake pins being positioned in the interior cavity and connected normal to the second concave wall;

the second plurality of stake pins being collinear with the locator insert;

the second interior ridge being positioned inside the interior cavity and connected around the second concave wall;

the second interior ridge being positioned adjacent to the locator insert opposite the living hinge;

the second exterior ridge being positioned outside and connected around the second concave wall opposite the second interior ridge; and the second exterior ridge being positioned between the second connection end and the second open end.

5. The insert assembly for an applicator as claimed in claim 1 comprises, a sleeve insertion section;

the interior cavity comprises an insert section;

the sleeve insertion section being formed opposite the insert section outside and around the first semi-cylindrical retention jaw and the second semi-cylindrical retention jaw;

the sleeve insertion section being positioned between the first exterior ridge and the first connection end;

the sleeve insertion section being positioned between the second exterior ridge and the second connection end;

the insert section being delineated by the first concave wall and the second concave wall;

the interior cavity being positioned between the first interior ridge and the first open end; and the interior cavity being positioned between the second interior ridge and the second open end.

6. The insert assembly for an applicator as claimed in claim 1 comprises, the plurality of attachment points being positioned adjacent to both the first connection end and the second connection end;

each of the plurality of attachment points comprises a semi-circular ridge, wherein the semi-circular ridge is a lug;

the semi-circular ridge comprises a notch; and the semi-circular ridge being concentric with the both the first semi-cylindrical retention jaw and the second semi-cylindrical retention jaw.

7. The insert assembly for an applicator as claimed in claim 1 comprises, the cylindrical over cap comprises an open end and a closed end;

both the first semi-cylindrical retention jaw and the second semi-cylindrical retention jaw traversing into the cylindrical over cap;

the open end being positioned adjacent to and flush with both the first exterior ridge and the second exterior ridge; and an insert held by the assembly being positioned interior to the cylindrical over cap.

8. An insert assembly for an applicator comprises, a first semi-cylindrical retention jaw;

a second semi-cylindrical retention jaw;

a living hinge;

an interior cavity;

a cylindrical over cap;

a plurality of attachment points;

a sleeve insertion section;

the first semi-cylindrical retention jaw comprises a first concave wall, a first connection end, a first open end, a first interior ridge, a first exterior ridge, a first plurality of stake pins, and a locator receptacle;

the second semi-cylindrical retention jaw comprises a second concave wall, a second connection end, a second open end, a second interior ridge, a second exterior ridge, a second plurality of stake pins, and a locator insert;

the first connection end being coupled to the second connection end by the living hinge;

the first plurality of stake pins being positioned in the interior cavity and connected normal to the first concave wall;

the first plurality of stake pins being collinear with the locator receptacle;

the second plurality of stake pins being positioned in the interior cavity and connected normal to the second concave wall;

the second plurality of stake pins being collinear with the locator insert;

the locator insert being engaged with the locator receptacle;

the interior cavity comprises an insert section;

the interior cavity being positioned opposite the living hinge between the first semi-cylindrical retention jaw and the second semi-cylindrical retention jaw; and the plurality of attachment points being connected outside and around the first concave wall and the second concave wall.

9. The insert assembly for an applicator as claimed in claim 8 comprises, the first connection end and the first open end being positioned opposite each other along the first concave wall;

the locator receptacle being positioned in the interior cavity and connected to the first concave wall;

the locator receptacle being normal to and bisecting the first concave wall;

the locator receptacle being positioned adjacent to the first connection end;

the first interior ridge being positioned inside the interior cavity and connected around the first concave wall;

the first interior ridge being positioned adjacent to the locator receptacle opposite the living hinge;

the first exterior ridge being positioned outside and connected around the first concave wall opposite the first interior ridge;

the first exterior ridge being positioned between the first connection end and the first open end; and the first plurality of stake pins being aligned opposite the second plurality of stake pins.

10. The insert assembly for an applicator as claimed in claim 8 comprises, the second connection end and the second open end being positioned opposite each other along the second concave wall;

the locator insert being positioned in the interior cavity and connected to the second concave wall;

the locator insert being normal to and bisecting the second concave wall;

the locator insert being positioned adjacent to the second connection end;

the second interior ridge being positioned inside the interior cavity and connected around the second concave wall;

the second interior ridge being positioned adjacent to the locator insert opposite the living hinge;

the second exterior ridge being positioned outside and connected around the second concave wall opposite the second interior ridge; and the second exterior ridge being positioned between the second connection end and the second open end.

11. The insert assembly for an applicator as claimed in claim 8 comprises, the sleeve insertion section being formed opposite the insert section outside and around the first semi-cylindrical retention jaw and the second semi-cylindrical retention jaw;

the sleeve insertion section being positioned between the first exterior ridge and the first connection end;

the sleeve insertion section being positioned between the second exterior ridge and the second connection end;

the insert section being delineated by the first concave wall and the second concave wall;

the interior cavity being positioned between the first interior ridge and the first open end; and the interior cavity being positioned between the second interior ridge and the second open end.

12. The insert assembly for an applicator as claimed in claim 8 comprises, the plurality of attachment points being positioned adjacent to both the first connection end and the second connection end;

each of the plurality of attachment points comprises a semi-circular ridge, wherein the semi-circular ridge is a lug;

the semi-circular ridge comprises a notch; and the semi-circular ridge being concentric with the both the first semi-cylindrical retention jaw and the second semi-cylindrical retention jaw.

13. The insert assembly for an applicator as claimed in claim 8 comprises, the cylindrical over cap comprises an open end and a closed end;

both the first semi-cylindrical retention jaw and the second semi-cylindrical retention jaw traversing into the cylindrical over cap;

the open end being positioned adjacent to and flush with both the first exterior ridge and the second exterior ridge; and an insert held by the assembly being positioned interior to the cylindrical over cap.

14. An insert assembly for an applicator comprises, a first semi-cylindrical retention jaw;

a second semi-cylindrical retention jaw;

a living hinge;

an interior cavity;

a cylindrical over cap;

a plurality of attachment points;

a sleeve insertion section;

the first semi-cylindrical retention jaw comprises a first concave wall, a first connection end, a first open end, a first interior ridge, a first exterior ridge, a first plurality of stake pins, and a locator receptacle;

the second semi-cylindrical retention jaw comprises a second concave wall, a second connection end, a second open end, a second interior ridge, a second exterior ridge, a second plurality of stake pins, and a locator insert;

the first connection end being coupled to the second connection end by the living hinge;

the first plurality of stake pins being positioned in the interior cavity and connected normal to the first concave wall;

the first plurality of stake pins being collinear with the locator receptacle;

the first exterior ridge being positioned outside and connected around the first concave wall opposite the first interior ridge;

the first exterior ridge being positioned between the first connection end and the first open end;

the second plurality of stake pins being positioned in the interior cavity and connected normal to the second concave wall;

the second plurality of stake pins being collinear with the locator insert;

the locator insert being engaged with the locator receptacle;

the second interior ridge being positioned adjacent to the locator insert opposite the living hinge;

the second exterior ridge being positioned outside and connected around the second concave wall opposite the second interior ridge;

the first plurality of stake pins being aligned opposite the second plurality of stake pins;

the interior cavity comprises an insert section;

the interior cavity being positioned opposite the living hinge between the first semi-cylindrical retention jaw and the second semi-cylindrical retention jaw;

the plurality of attachment points being connected outside and around the first concave wall and the second concave wall; and the plurality of attachment points being positioned adjacent to both the first connection end and the second connection end.

15. The insert assembly for an applicator as claimed in claim 14 comprises, the first connection end and the first open end being positioned opposite each other along the first concave wall;

the locator receptacle being positioned in the interior cavity and connected to the first concave wall;

the locator receptacle being normal to and bisecting the first concave wall;

the locator receptacle being positioned adjacent to the first connection end;

the first interior ridge being positioned inside the interior cavity and connected around the first concave wall; and the first interior ridge being positioned adjacent to the locator receptacle opposite the living hinge.

16. The insert assembly for an applicator as claimed in claim 14 comprises, the second connection end and the second open end being positioned opposite each other along the second concave wall;

the locator insert being positioned in the interior cavity and connected to the second concave wall;

the locator insert being normal to and bisecting the second concave wall;

the locator insert being positioned adjacent to the second connection end;

the second interior ridge being positioned inside the interior cavity and connected around the second concave wall; and the second exterior ridge being positioned between the second connection end and the second open end.

17. The insert assembly for an applicator as claimed in claim 14 comprises, the sleeve insertion section being formed opposite the insert section outside and around the first semi-cylindrical retention jaw and the second semi-cylindrical retention jaw;

the sleeve insertion section being positioned between the first exterior ridge and the first connection end;

the sleeve insertion section being positioned between the second exterior ridge and the second connection end;

the insert section being delineated by the first concave wall and the second concave wall;

the interior cavity being positioned between the first interior ridge and the first open end; and the interior cavity being positioned between the second interior ridge and the second open end.

18. The insert assembly for an applicator as claimed in claim 14 comprises, each of the plurality of attachment points comprises a semi-circular ridge, wherein the semi-circular ridge is a lug;

the semi-circular ridge comprises a notch; and the semi-circular ridge being concentric with the both the first semi-cylindrical retention jaw and the second semi-cylindrical retention jaw.

19. The insert assembly for an applicator as claimed in claim 14 comprises, the cylindrical over cap comprises an open end and a closed end;

both the first semi-cylindrical retention jaw and the second semi-cylindrical retention jaw traversing into the cylindrical over cap;

the open end being positioned adjacent to and flush with both the first exterior ridge and the second exterior ridge; and an insert held by the assembly being positioned interior to the cylindrical over cap.

* * * * *